US008087910B2

(12) United States Patent
Yajima

(10) Patent No.: US 8,087,910 B2
(45) Date of Patent: Jan. 3, 2012

(54) CHEMICAL LIQUID SUPPLYING APPARATUS

(75) Inventor: Takeo Yajima, Tokyo (JP)

(73) Assignee: Koganei Corporation, Tokyo (JP)

( * ) Notice: Subject to any disclaimer, the term of this patent is extended or adjusted under 35 U.S.C. 154(b) by 1044 days.

(21) Appl. No.: 11/909,083

(22) PCT Filed: Apr. 6, 2006

(86) PCT No.: PCT/JP2006/307360

§ 371 (c)(1),
(2), (4) Date: Sep. 19, 2007

(87) PCT Pub. No.: WO2006/112271

PCT Pub. Date: Oct. 26, 2006

(65) Prior Publication Data

US 2009/0123312 A1 May 14, 2009

(30) Foreign Application Priority Data

Apr. 13, 2005 (JP) ..... 2005-115634

(51) Int. Cl.
*F04B 43/08* (2006.01)

(52) U.S. Cl. ..... 417/478

(58) Field of Classification Search ..... 417/118, 417/119, 473, 475, 395, 478
See application file for complete search history.

(56) References Cited

U.S. PATENT DOCUMENTS 1,513,052 A * 10/1924 Larkin ..... 92/37
1,580,479 A * 4/1926 Frankenfield ..... 417/244
1,692,921 A * 11/1928 Banning, Jr. ..... 417/473
1,715,735 A * 6/1929 Banning, Jr. ..... 417/473
2,613,607 A * 10/1952 Sheen et al. ..... 417/388
2,613,610 A * 10/1952 Saalfrank ..... 417/313
2,951,450 A * 9/1960 Fisher ..... 417/273
3,182,597 A * 5/1965 Malizard et al. ..... 417/339
3,598,505 A * 8/1971 Greene et al. ..... 417/220
4,417,861 A 11/1983 Tolbert (Continued)

FOREIGN PATENT DOCUMENTS

JP 60-008485 1/1985

(Continued)

OTHER PUBLICATIONS

International Search Report of PCT/JP2006/307360.

*Primary Examiner* — Devon C Kramer
*Assistant Examiner* — Amene Bayou
(74) *Attorney, Agent, or Firm* — McCormick, Paulding & Huber LLP

(57) ABSTRACT

A chemical liquid supplying apparatus 10 has a bellows 11, which includes a small-size bellows portion 13, a large-size bellows portion 14 with a larger volume change per axial-directional unit displacement amount than that of the small-size bellows portion 13, and a drive portion 12 therebetween. An apparatus main body 10*a* to which the bellows 11 is attached includes a supporting member 21 to which a fixed end portion 15 of the bellows 11 is attached and a supporting member 22 to which a fixed end portion 16 of the bellows 11 is attached. A drive sleeve 27 surrounds the bellows 11 and is rotatably supported on the apparatus main body 10*a*. A driven cylinder body 32 attached to the drive portion 12 converts rotation of the drive sleeve 27 to axial-directional movement of the drive portion 12.

5 Claims, 5 Drawing Sheets

U.S. PATENT DOCUMENTS

| | | | | |
|---|---|---|---|---|
| 4,886,432 | A | 12/1989 | Kimberlin | |
| 4,902,206 | A * | 2/1990 | Nakazawa et al. | 417/394 |
| 5,964,580 | A * | 10/1999 | Taga | 417/394 |
| 6,183,223 | B1 * | 2/2001 | Yajima | 417/478 |
| 6,238,576 | B1 * | 5/2001 | Yajima | 210/767 |

FOREIGN PATENT DOCUMENTS

| | | |
|---|---|---|
| JP | 10-054368 | 2/1998 |
| JP | 10-061558 | 3/1998 |
| JP | 2001-153054 | 6/2001 |
| JP | 2004-301255 | 10/2004 |

* cited by examiner

CHEMICAL LIQUID SUPPLYING APPARATUS

TECHNICAL FIELD

The present invention relates to a chemical liquid supplying apparatus which discharges a predetermined amount of liquid such as chemical liquid.

BACKGROUND ART

A process for manufacturing a liquid crystal substrate or semiconductor substrate includes a step of applying the substrate using chemical liquid such as photoresist liquid and etching liquid. For example, in the step of applying the liquid crystal substrate using the photoresist liquid, as described in Patent Document 1, there has been used a chemical liquid supplying apparatus with a bellows comprising a large bellows portion and a small bellows portion, which are axially elastically deformable on both axial-directional sides of an annular drive portion, whereby a pump chamber is expanded and contracted by axial-directional elastic deformation of the bellows.

Patent document 1: Japanese Patent No. 3554115

DISCLOSURE OF THE INVENTION

Problems to be Solved by the Invention

In a conventional chemical liquid supplying apparatus with the bellows including the large bellows portion and the small bellows portion, a nut driven by a ball screw provided in parallel to the bellows is connected to a drive portion by an engaging member in order to allow the drive portion to be axially displaced. Consequently, when the bellows is deformed axially elastically, a tilting force is applied to the nut and bellows in such a direction that they are tilted. To withstand this tilting force, the conventional chemical liquid supplying apparatus needs to use a large linear guide, so that the apparatus is enlarged and an apparatus main body for supporting the ball screw and guide also needs a rigid structure.

An object of the present invention is to provide a lightweight, small-size chemical liquid supplying apparatus.

Means for Solving the Problem

A chemical liquid supplying apparatus according to the present invention is an apparatus for expanding a pump chamber to suck chemical liquid into the pump chamber and contracting the pump chamber to discharge the chemical liquid to an exterior of the pump chamber, the apparatus comprising: a bellows including a small-size bellows portion, a large-size bellows portion with a larger volume change per axial-directional unit displacement amount than that of the small-size bellows portion, and a drive portion provided between the small-size bellows portion and the large-size bellows portion, the bellows being deformed axially elastically to expand/contract the pump chamber; an apparatus main body including an inflow-side supporting member for attaching an inflow-side fixed end portion of the bellows and an outflow-side supporting member for attaching an outflow-side fixed end portion of the bellows; a drive sleeve disposed outside the bellows and supported rotatably on the apparatus main body; a driven cylinder body attached to the drive portion to convert rotation movement of the drive sleeve to axial-directional movement of the drive portion; and drive means for rotating the drive sleeve.

The chemical liquid supplying apparatus according to the present invention is such that a flexible tube, whose both ends are held by the respective fixed end portions and in which a pump chamber is formed, is disposed inside the bellows, and an incompressible medium is enclosed in an expansion/contraction chamber formed between the bellows and the flexible tube.

The chemical liquid supplying apparatus according to the present invention is such that a male screw is formed in the drive sleeve, and a female screw meshing with the male screw is formed in the driven cylinder body.

The chemical liquid supplying apparatus according to the present invention is such that the drive means is a motor, and a timing belt is provided between a drive pulley fixed to a shaft of the motor and a driven pulley provided on the drive sleeve.

The chemical liquid supplying apparatus according to the present invention is such that an inflow-side opening/closing valve, which allows a flow of the chemical liquid into the pump chamber when the pump chamber is expanded and blocks the flow of the chemical liquid into the pump chamber when the pump chamber is contracted, is provided at the inflow-side fixed end portion, and an outflow-side opening/closing valve, which blocks the flow of the chemical liquid into the pump chamber when the pump chamber is expanded and allows the flow of the chemical liquid out of the pump chamber when the pump chamber is contracted, is provided at the outflow-side fixed end portion.

Effect of the Invention

According to the present invention, the rotation of the drive sleeve disposed outside the bellows is converted to the axial-directional movement of the driven cylinder body attached to the drive portion to reciprocate axially the drive portion of the bellows, so that no force is applied to the bellows in a direction of tilting it and the bellows can be driven by the drive sleeve which rotates around the bellows, whereby discharge precision of the pump can be enhanced. Further, the bellows is driven by the drive sleeve through the driven cylinder body, so that any large guide is not required as compared with the case of linking, to the drive portion of the bellows via an engaging member, a nut screwed to a ball screw driven by the motor. Therefore, the chemical liquid supplying apparatus can be made light in weight and small in size.

BEST MODE FOR CARRYING OUT THE INVENTION

Hereinafter, embodiments of the present invention will be described in detail with reference to the accompanying drawings.

Figure 1:
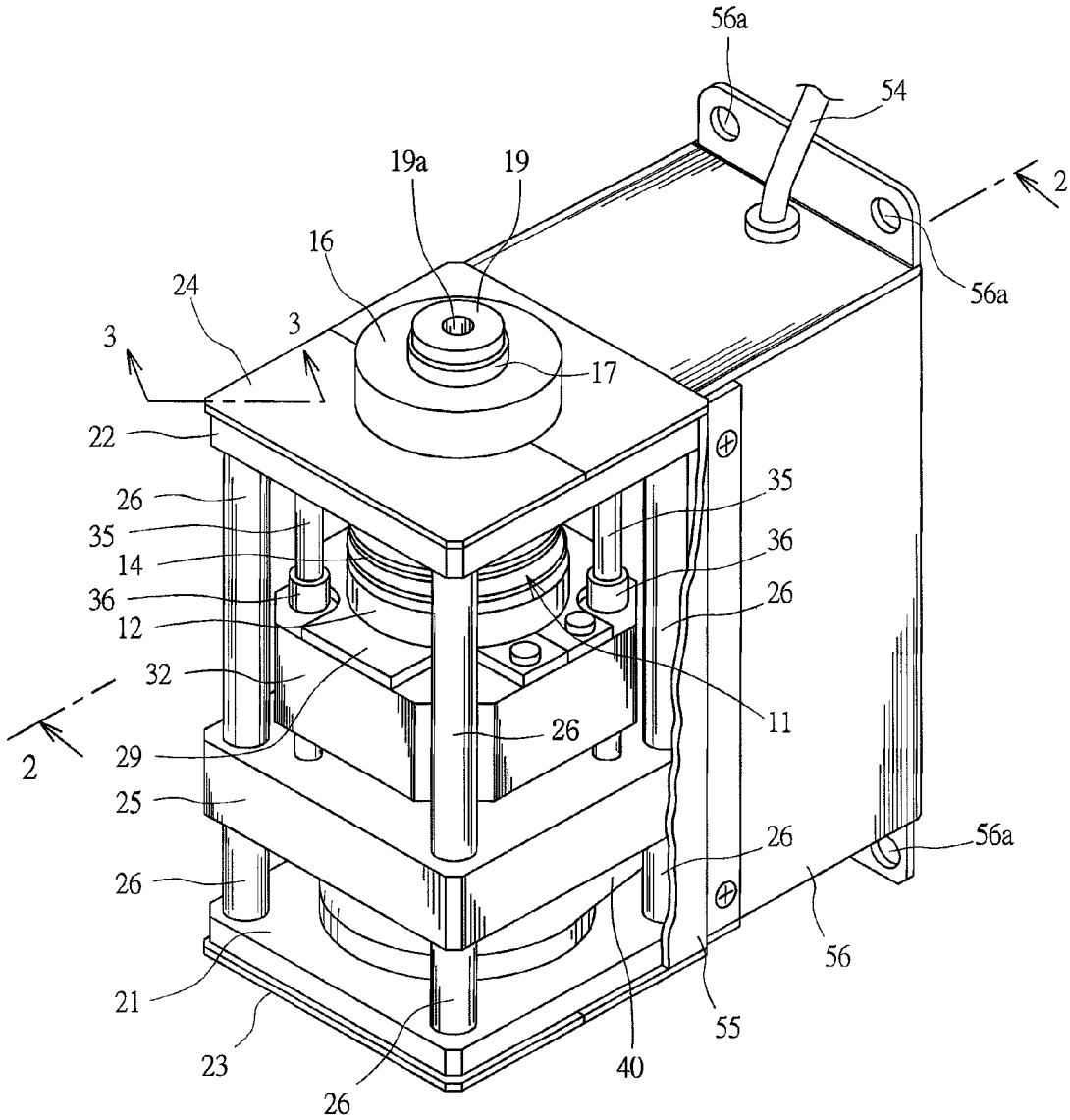
FIG. 1 is a partially broken perspective view showing a chemical liquid supplying apparatus according to an embodiment of the present invention.
Figure 2:
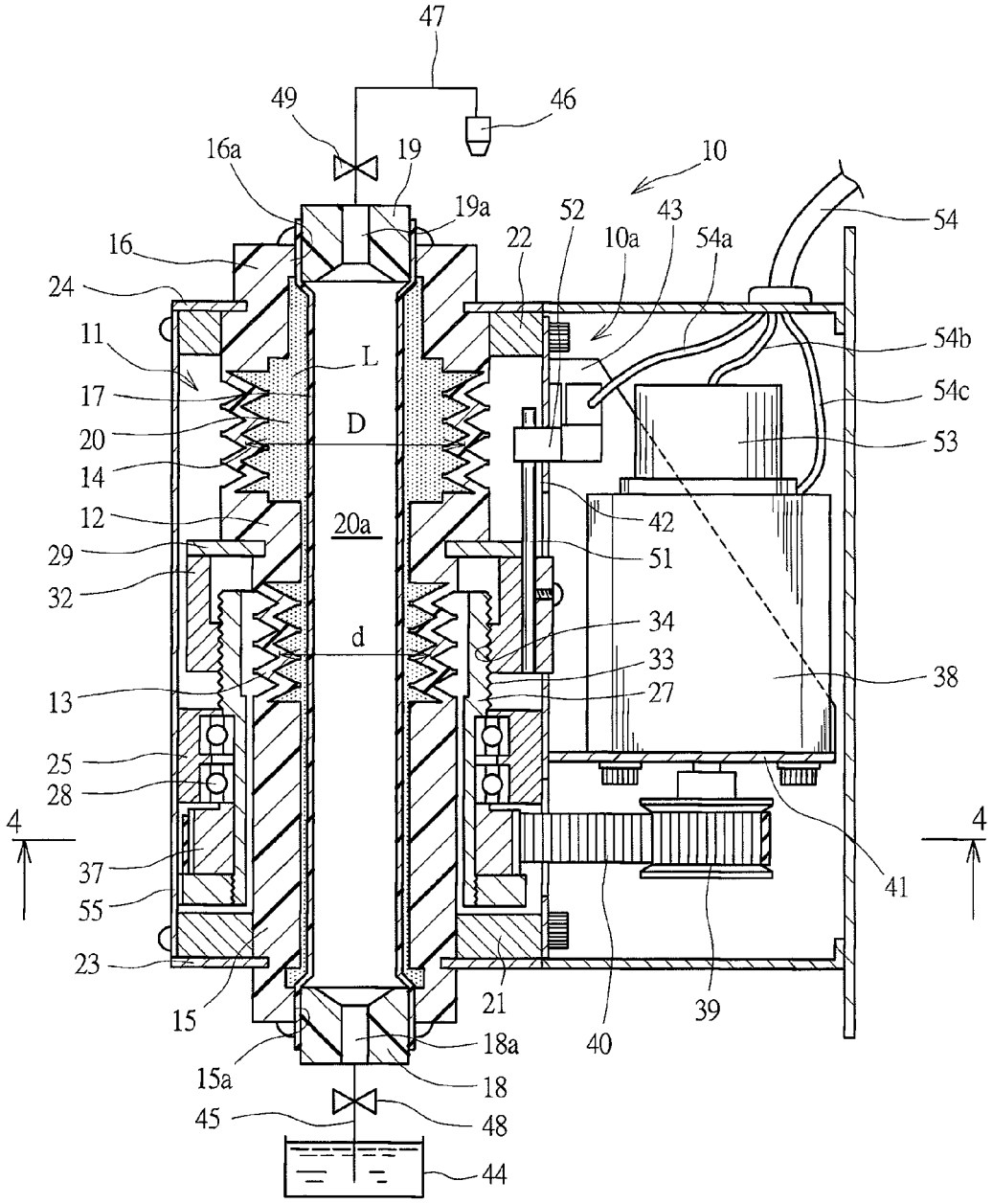
FIG. 2 is a longitudinal sectional view taken along line 2-2 in FIG. 1.

As shown in FIGS. 1 and 2, a chemical liquid supplying apparatus 10 has an entirely substantially cylindrical bellows 11 made of a resin. As shown in FIG. 2, the bellows 11 comprises an annular drive portion 12, a small-size bellows portion 13 provided integrally on one axial-directional side thereof, and a large-size bellows portion 14 provided integrally on the other side of the drive portion 12. A cylindrical fixed end portion 15 is provided on an inflow side of the bellows 11 so as to be continuous with the small-size bellows portion 13, and a cylindrical fixed end portion 16 is provided on an outflow side of the bellows 11 so as to be continuous with the large-size bellows portion 14.

The small-size bellows portion 13 and the large-size bellows portion 14 are formed into thinner accordion shapes in thickness than their other portions, i.e., the drive portion 12 and the fixed end portions 15 and 16, so that if the drive portion 12 is displaced axially, the respective bellows portions are deformed axially elastically. Assuming that an effective diameter of the small-size bellows portion 13 is "d" and that of the large-size bellows portion 14 is "D", the large-size bellows portion 14 has a larger effective diameter than the small-size bellows portion 13. Because the small-size bellows portion 13 and the large-size bellows portion 14 are provided on both axial-directional sides of the drive portion 12 and the effective diameter D of the large-size bellows portion 14 is larger than the effective diameter d of the small-size bellows portion 13, when the drive portion 12 is displaced to a lower side shown in FIG. 2, i.e., in a direction of contracting the small-size bellows portion 13 axially, the large-size bellows portion 14 with the larger effective diameter is expanded axially and the small-size bellows portion 13 with the smaller effective diameter is contracted axially, so that a portion with a large inner diameter is increased in the bellows 11 and that an inner volume of the bellows 11 is wholly increased. Meanwhile, if the drive portion 12 is displaced in an opposite direction to the above, the small-size bellows portion 13 with the small effective diameter is expanded axially and the large-size bellows portion 14 with the large effective diameter is contracted axially, so that a portion with a small inner diameter is increased in the bellows 11 and that the inner volume of the bellows 11 is wholly reduced. Thus, the volume in the bellows 11 is varied by displacing the drive portion 12 axially to perform a pump operation.

Incidentally, if positions of the small-size bellows portion 13 and the large-size bellows portion 14 are inverted, when the drive portion 12 is displaced to the inflow side of the drive portion 12, i.e., to a lower side shown in FIG. 2, the volume in the bellows 11 is decreased and if the drive portion 12 is displaced to the outflow side, i.e., to an upper side shown in FIG. 2, the volume in the bellows 11 is increased.

Figure 4:
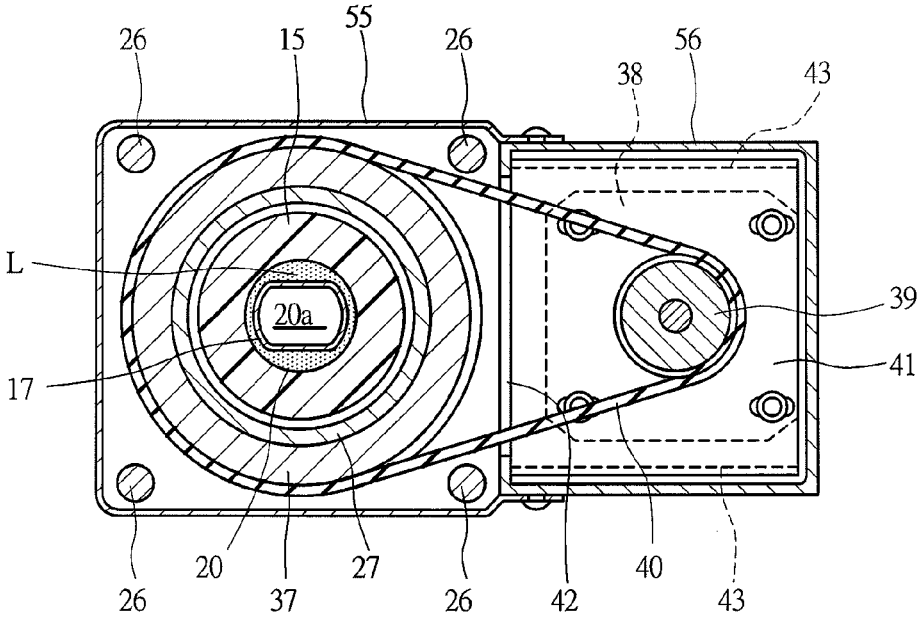
FIG. 4 is a lateral sectional view taken along line 4-4 in FIG. 2.

A flexible tube 17, which is formed of an elastic material and is deformable radially elastically, is incorporated into the bellows 11. An end portion of the flexible tube 17 is fixed to an opening hole 15*a* of a fixed end portion 15 by an inflow-side adapter 18 fitted inside the end portion, and the other end portion of the flexible tube 17 is fixed to an opening hole 16*a* of a fixed end portion 16 by an outflow-side adapter 19 fitted inside the other end portion. The flexible tube 17 and the inflow-side and outflow-side adapters 18 and 19 are formed of fluoroethylene perfluoroalkylvinylether copolymer (PFA) which is a fluoro resin reacting with no chemical liquid. The bellows 11 is also formed of PFA. In contrast, the bellows may be manufactured from a resin other than PFA or from metal since contacting with no chemical liquid. Both end portions of the flexible tube 17 have such circular cross sections as to correspond to the circular opening holes 15*a* and 16*a*, and a portion other than the both end portions becomes a flat shape as shown in FIG. 4.

A space formed by the bellows 11 and the flexible tube 17 serves as an expansion/contraction chamber 20, wherein an incompressible medium "L" such as liquid is enclosed in this expansion/contraction chamber 20 as shown in FIG. 2. Thus, if the drive portion 12 is displaced in a direction of contracting the small-size bellows portion 13 axially, axial-directional length of the large-size bellows portion 14 with the large effective diameter is increased, and the volume of the expansion/contraction chamber 20 inside the bellows 11 is wholly increased, so that the flexible tube 17 is expanded radially through the incompressible medium L. Meanwhile, if the drive portion 12 is displaced in a direction of contracting the large-size bellows portion 14 axially, axial-directional length of the small-size bellows portion 13 with the small effective diameter is increased, and the volume of the expansion/contraction chamber 20 inside the bellows 11 is wholly decreased, so that the flexible tube 17 is contracted radially through the incompressible medium L. Thus, when the drive portion 12 is displaced axially, the flexible tube 17 is expanded/contracted radially through the incompressible medium L, and a pump chamber 20*a* inside the flexible tube 17 is expanded/contracted, whereby the flexible tube 17 performs the pump operation.

Figure 3:
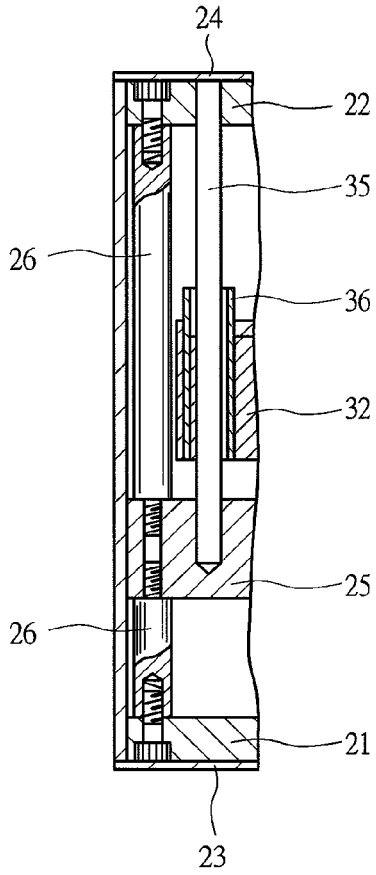
FIG. 3 is a sectional view taken along line 3-3 in FIG. 1.

The bellows 11 is attached to an apparatus main body 10*a*, and the apparatus main body 10*a* has an inflow-side supporting member 21 to which the inflow-side fixed end portion 15 is attached and an outflow-side supporting member 22 to which the outflow-side fixed end portion 16 is attached. The respective supporting members 21 and 22 have fitting holes in which the fixed end portions 16 and 17 are fitted, and are formed of substantially square metal plates as shown in FIG. 1. A fixing plate 23, which is engaged with an engagement groove formed in the fixed end portion 15, is attached to the supporting member 21, and a fixing plate 24, which is engaged with an engagement groove formed in the fixed end portion 16, is attached to the supporting member 22. Incidentally, each of the fixing plates 23 and 24 is split into two sections. A holder 25 is disposed between the respective supporting members 21 and 22, and the holder 25 is also formed in a substantially square shape as shown in FIG. 1. As shown in FIG. 3, both of the supporting members 21 and 22 are connected to the holder 25 via a plurality of supporting columns 26, and the fixed end portions 15 and 16 are fixed to the apparatus main body 10*a* via the supporting members 21 and 22.

As shown in FIG. 2, a substantially cylindrical drive sleeve 27 is disposed outside the bellows 11. The drive sleeve 27 is disposed coaxially with the bellows 11 via a slight gap outside the bellows 11 and supported by the holder 25 rotatably via a bearing 28. Two-split fixing plates 29 are engaged with an engagement groove formed in the drive portion 12, a substantially cylindrical driven cylinder body 32 is attached to the drive portion 12 via these fixing plates 29, and this driven cylinder body 32 is fitted outside the drive sleeve 27.

A male screw 33 is formed on an outer face of the drive sleeve 27 and a female screw 34 meshing with the male screw 33 is formed in the driven cylinder body 32. Therefore, if the drive sleeve 27 is rotated, rotational movement of the drive sleeve 27 is converted to axial-directional movement of the driven cylinder body 32 by the mesh of the screws, so that the driven cylinder body 32 is driven axially. In order that the driven cylinder body 32 is not rotated and moves axially according to rotation of the drive sleeve 27, as shown in FIGS. 1 and 3, a plurality of guide rods 35 whose both ends are fixed to the holder 25 and the supporting member 22 pass through the driven cylinder body 32. Collars 36 fitted to the guide rods 35 are attached to the driven cylinder body 32.

Although each of the male screw 33 and the female screw 34 has a thread with a triangular cross section, it may be a trapezoidal screw thread or may be a ball screw thread in which balls are interposed between the screws 33 and 34. So long as any structure is one for converting the rotation of the drive sleeve 27 to the axial-directional movement of the driven cylinder body 32, it may be a structure in which: one of the drive sleeve 27 and the driven cylinder body 32 is provided with a projection; and a spiral engagement groove engaged with the projection is formed at the other thereof so that the rotation of the drive sleeve 27 is converted to the axial-directional movement of the driven cylinder body 32 by engaging the projection and the engagement groove.

To drive rotationally the drive sleeve 27, as shown in FIG. 2, the drive sleeve 27 is provided with a driven-side pulley 37, and a timing belt 40 is bridged between a drive-side pulley 39 attached to a main shaft of a motor 38 and the driven-side pulley 37. Incidentally, it is permissible to replace the pulleys 37 and 39 with sprockets and bridge a chain between the both sprockets. Alternatively, it is permissible to provide the drive sleeve 27 with a gear and attach another gear meshing therewith to the main shaft of the motor 38. As shown in FIG. 2, the motor 38 is attached to a supporting plate 41, and this supporting plate 41 is attached to a vertical plate 42 fixed to the supporting members 21 and 22 on a rear face side of the holder 25, and simultaneously a reinforcement flange 43 provided on both sides of the supporting plate 41 is attached to the vertical plate 42.

If the drive sleeve 27 is rotated in a single direction by the motor 38 via the driven-side pulley 37, the driven cylinder body 32 screwed to the drive sleeve 27 is driven axially toward one fixed end portion 15, so that the drive portion 12 of the bellows 11 is displaced axially toward the fixed end portion 15. Consequently, the expansion/contraction chamber 20 inside the bellows 11 is expanded, and the pump chamber 20*a* inside the flexible tube 17 is expanded. On the other hand, if the drive sleeve 27 is rotated inversely by inverting the rotation of the motor 38, the driven cylinder body 32 is driven axially toward the other fixed end portion 16, so that the drive portion 12 of the bellows 11 is displaced axially toward the fixed end portion 16. Consequently, the expansion/contraction chamber 20 inside the bellows 11 is contracted, and the pump chamber 20*a* inside the flexible tube 17 is contracted.

As shown in FIG. 2, a flow path 45, which is connected to a tank 44 for accommodating chemical liquid such as photoresist liquid, is connected to a communication hole 18*a* of the inflow-side adapter 18, and a flow path 47, which is connected to a nozzle 46 for applying the chemical liquid, is connected to a communication hole 19*a* of the outflow-side adapter 19. The flow path 45 is provided with an inflow-side opening/closing valve 48, so that when the pump chamber 20*a* is expanded, this inflow-side opening/closing valve 48 opens the flow path 45 to cause the chemical liquid in the tank 44 to flow into the pump chamber 20*a*, and when the pump chamber 20*a* is contracted, the inflow-side opening/closing valve closes the flow path 45 to block an outflow of the chemical liquid in the pump chamber 20*a*. The flow path 47 is provided with an outflow-side opening/closing valve 49, so that when the pump chamber 20*a* is expanded, this outflow-side opening/closing valve 49 closes the flow path 47 to block a back flow of the chemical liquid into the pump chamber 20*a* from the flow path 47, and when the pump chamber 20*a* is contracted, the outflow-side opening/closing valve opens the flow path 47 to discharge the chemical liquid in the pump chamber 20*a* to the nozzle 46. Although check valves are used as the respective opening/closing valves 48 and 49, an electromagnetic valve or air operated valve for opening/closing the flow path according to a signal sent from the outside may be used instead of the check valve.

As shown in FIG. 2, a sensing rod 51 is attached to the driven cylinder body 32, and a sensor 52 is attached to the vertical plate 42 so as to correspond to the sensing rod 51. The sensor 52 is provided with a light projecting portion and a light receiving portion, which face to each other via a gap, so that an axial-directional position of the driven cylinder body 32 is detected according to a position where the sensing rod 51 interrupts light from the light projecting portion and a position where the sensing rod 51 allows light to be transmitted. An encoder 53 for detecting revolution of the main shaft of the motor is attached to the motor 38, and detection signals from the sensor 52 and the encoder 53 are sent to an exterior control circuit located via cables 54*a* and 54*b*, and simultaneously a drive signal is sent to the motor 38 from the control circuit via a cable 54*c*.

A cover 55 is attached to the apparatus main body 10*a* to cover a pump section having the upper and lower supporting members 21 and 22, and a cover 56 is attached to cover the motor 38. The cables 54*a* to 54*c* are bound together and, as shown by the reference numeral "54" in FIGS. 1 and 2, are drawn from the cover 56 to the outside. As shown in FIG. 1, through holes 56*a*, through which screw members pass in order to attach the apparatus main body 10*a* to an apparatus installation member, are formed.

In this chemical liquid supplying apparatus, the drive sleeve 27 mounted rotatably on the holder 25 fixed to the apparatus main body 10*a* is disposed coaxially with the bellows 11 and outside the bellows 11, and the drive portion 12 is driven axially by the cylindrical driven cylinder body 32 fitted coaxially with the bellows 11 outside the drive sleeve 27. Consequently, a drive force obtained by converting the rotation movement of the drive sleeve 27 to the axial-directional movement via the driven cylinder body 32 is applied evenly axially from an entire circumferential direction with respect to the drive portion 12, so that the drive portion 12 is driven axially without receiving any deflected drive force. Accordingly, since the drive portion 12 is driven axially with its center axis not being tilted, pump discharge precision is enhanced. In addition, because the rotation movement of the drive sleeve 27 is directly converted to the axial-directional movement of the driven cylinder body 32, only an axial-directional stress is applied to the holder 25 but no bending force is applied thereto. Consequently, a member for transmitting the drive force of the motor 38 to the drive portion 12 does not need to have a large or rigid structure, so that since any large guide is not needed, the apparatus can be downsized.

Figure 5:
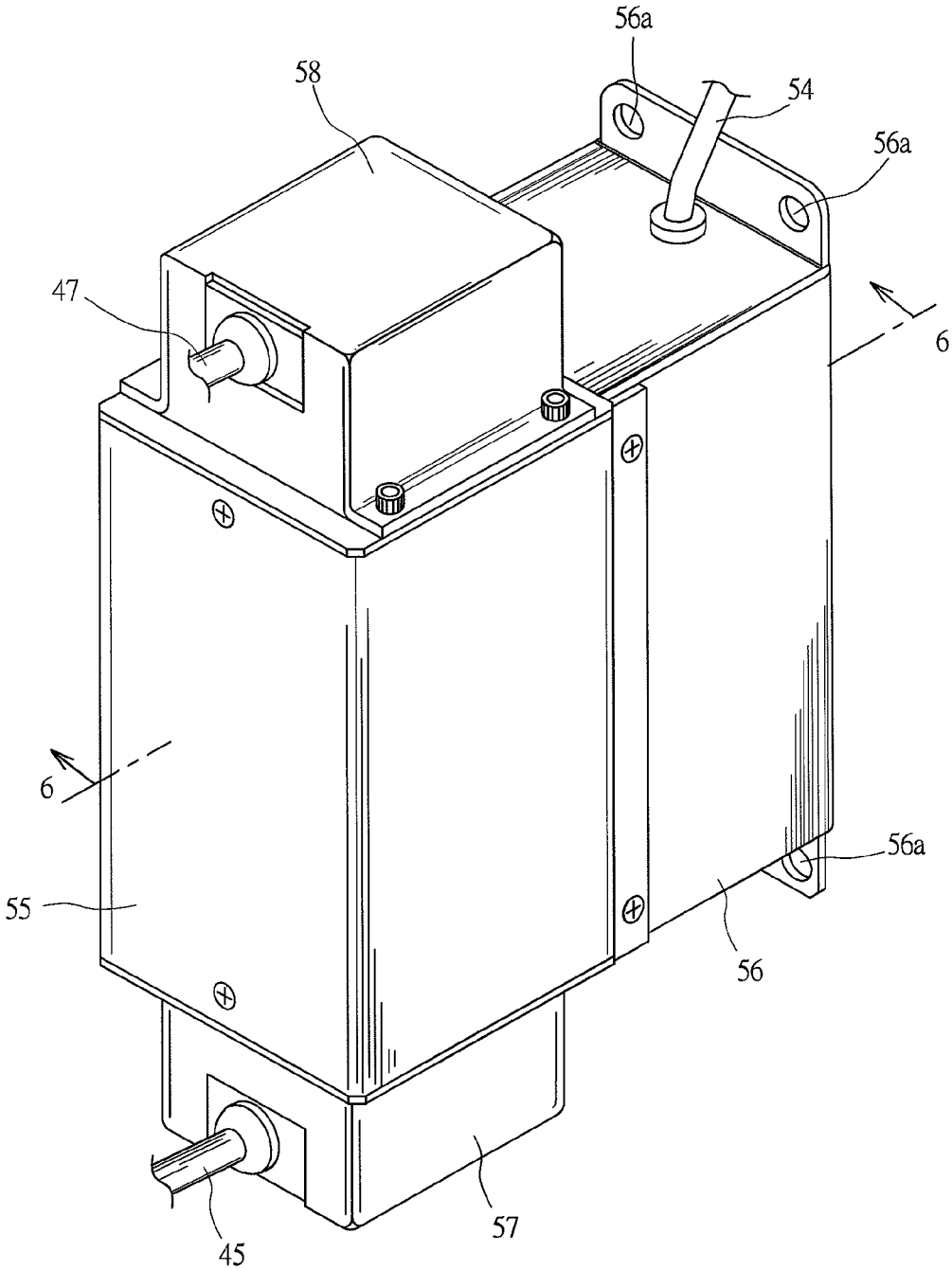
FIG. 5 is a perspective view showing an appearance of a chemical liquid supplying apparatus according to another embodiment of the present invention.
Figure 6:
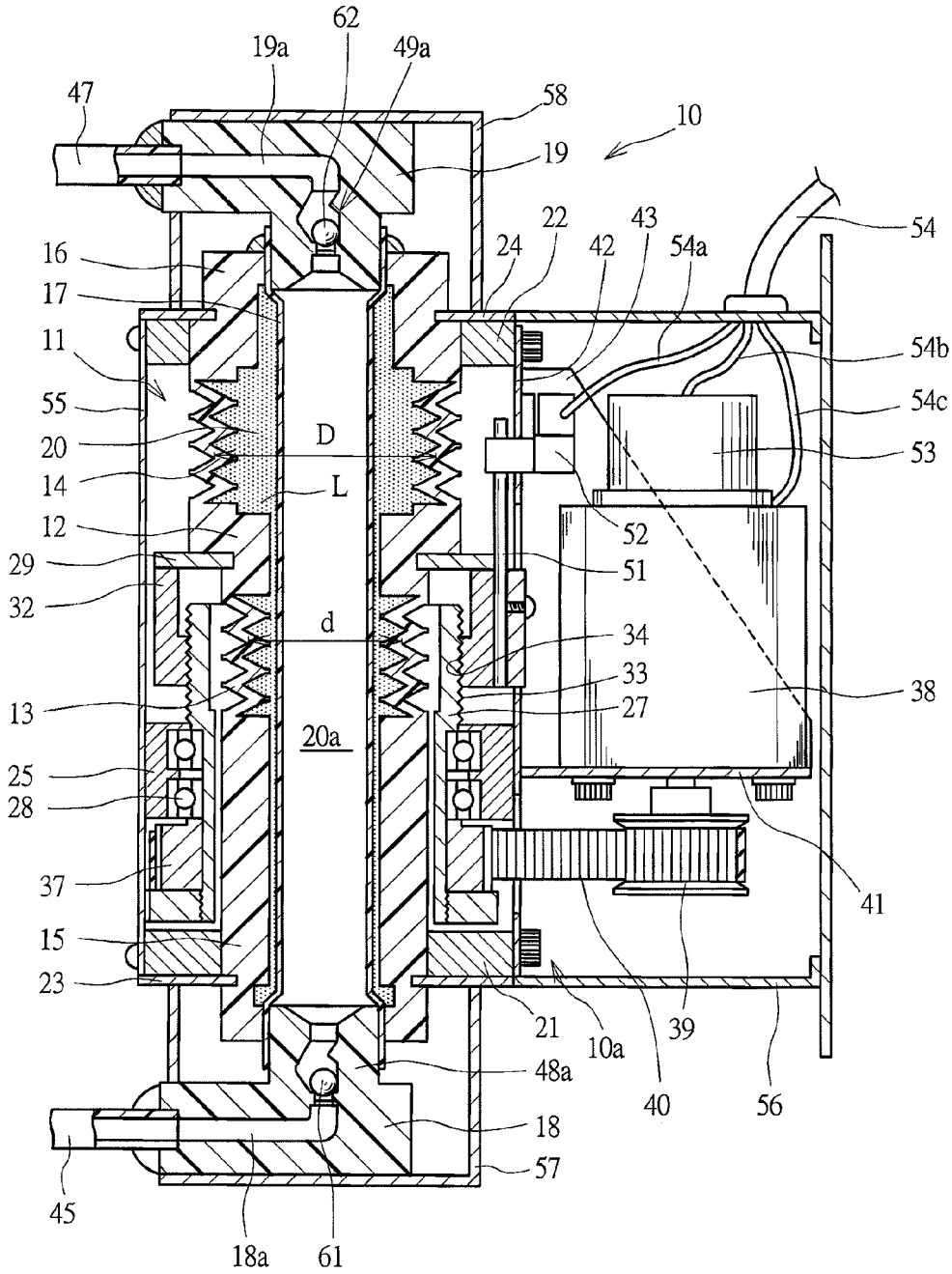
FIG. 6 is a longitudinal sectional view taken along line 6-6 in FIG. 5.

FIG. 5 is a perspective view showing an appearance of a chemical liquid supplying apparatus according to another embodiment of the present invention, and FIG. 6 is a longitudinal sectional view taken along line 6-6 in FIG. 5. Incidentally, in FIGS. 5 and 6, members common to those shown in FIGS. 1 to 4 are denoted by the same reference numerals.

As shown in FIG. 6, a check valve 48*a* for opening/closing the communication hole 18*a* which communicates with the flow path 45 is incorporated into the inflow-side adapter 18, and a check valve 49*a* for opening/closing the communication hole 19*a* which communicates with the flow path 47 is incorporated into the outflow-side adapter 19. The check valve 48*a* constitutes an inflow-side opening/closing valve, and the check valve 49*a* constitutes an outflow-side opening/closing valve. The respective check valves 48*a* and 49*a* are attached to the fixed end portions 15 and 16 via the adapters 18 and 19, and the respective adapters 18 and 19 are covered with covers 57 and 58. As described in Japanese Patent Application Laid-Open Publication No. 2001-153054, the respective check valves 48*a* and 49*a* are formed by fitting, into accommodation holes formed in the adapters 18 and 19, guide members into which balls 61 and 62 are incorporated, respectively. The chemical liquid supplying apparatus shown in FIGS. 5 and 6 has the same structure as that of the chemical liquid supplying apparatus shown in FIGS. 1 to 4 except that the check valves 48*a* and 49*a* are incorporate into the adapters 18 and 19.

In the chemical liquid supplying apparatus of the present invention, as shown in FIGS. 1 to 6, the cylindrical drive sleeve 27 is disposed outside the bellows 11, and the driven cylinder body 32 for converting the rotation movement of the drive sleeve 27 to the axial-directional movement of the drive portion 12 of the bellows 11 is attached to the drive portion 12. Consequently, when the drive portion 12 is driven axially, the drive sleeve 27 is not tilted. For this reason, since any large guide is not required, downsizing of the chemical liquid supplying apparatus is achieved and simultaneously the chemical liquid can be discharged with high precision.

In the above embodiment, the flexible tube 17 is incorporated inside the bellows 11, and the pump chamber 20*a* inside the flexible tube 17 is expanded/contracted via the expansion/contraction chamber 20 formed between the bellows 11 and the flexible tube 17. However, the expansion/contraction chamber 20 inside the bellows 11 may be employed directly as a pump chamber without provision of the flexible tube 17. In such a case, the bellows 11 is preferably formed of PFA.

The present invention is not limited to the above-described embodiments and may be variously modified within a scope of not departing from the gist thereof. For example, the chemical liquid supplying apparatus 10 may be used for supplying not only photoresist liquid but also other chemical liquid and pure water.

INDUSTRIAL APPLICABILITY

The chemical liquid supplying apparatus of the present invention is used for supplying chemical liquid such as photoresist liquid and etching liquid in a process of manufacturing a liquid crystal substrate or semiconductor integrated circuit.

The invention claimed is:

1. A chemical liquid supplying apparatus for expanding a pump chamber to suck chemical liquid into the pump chamber and contracting the pump chamber to discharge the chemical liquid to an exterior of the pump chamber, the apparatus comprising:

a bellows including a small-size bellows portion, a large-size bellows portion with a larger volume change per axial-directional unit displacement amount than that of the small-size bellows portion, and a drive portion provided between the small-size bellows portion and the large-size bellows portion, the bellows being deformed axially elastically to expand/contract the pump chamber;

an apparatus main body including an inflow-side supporting member for attaching an inflow-side fixed end portion of the bellows and an outflow-side supporting member for attaching an outflow-side fixed end portion of the bellows;

a drive sleeve surrounding the bellows and supported rotatably on the apparatus main body;

a driven cylinder body attached to the drive portion to convert rotation movement of the drive sleeve to axial-directional movement of the drive portion; and drive means for rotating the drive sleeve.

2. The chemical liquid supplying apparatus according to claim 1, wherein a flexible tube, whose both ends are held by the respective fixed end portions and in which the pump chamber is formed, is disposed inside the bellows, and an incompressible medium is enclosed in an expansion/contraction chamber formed between the bellows and the flexible tube.

3. The chemical liquid supplying apparatus according to claim 1, wherein a male screw is formed in the drive sleeve, and a female screw meshing with the male screw is formed in the driven cylinder body.

4. The chemical liquid supplying apparatus according to claim 1, wherein the drive means is a motor, and a timing belt is provided between a drive pulley fixed to a shaft of the motor and a driven pulley provided on the drive sleeve.

5. The chemical liquid supplying apparatus according to claim 1, wherein an inflow-side opening/closing valve, which allows a flow of the chemical liquid into the pump chamber when the pump chamber is expanded and blocks an outflow of the chemical liquid in the pump chamber when the pump chamber is contracted, is provided at the inflow-side fixed end portion, and an outflow-side opening/closing valve, which blocks the flow of the chemical liquid into the pump chamber when the pump chamber is expanded and allows the flow of the chemical liquid out of the pump chamber when the pump chamber is contracted, is provided at the outflow-side fixed end portion.

* * * * *